United States Patent [19]

Blanchard

[11] Patent Number: 4,884,727

[45] Date of Patent: Dec. 5, 1989

[54] HANGER WITH SNAP-ON ADJUSTABLE CLIPS

[75] Inventor: Russell O. Blanchard, Zeeland, Mich.

[73] Assignee: Batts, Inc., Mich.

[21] Appl. No.: 303,496

[22] Filed: Jan. 27, 1989

[51] Int. Cl.[4] ..... A47G 25/48

[52] U.S. Cl. ..... 223/93; 24/511

[58] Field of Search ..... 223/85, 91, 93, 96, 223/90; 211/124; 24/485, 489, 499, 501, 508, 511, 564

[56] References Cited

U.S. PATENT DOCUMENTS

| | | | |
|---|---|---|---|
| 2,471,606 | 5/1949 | Burns | 24/511 X |
| 2,583,784 | 1/1952 | Maccaferri | 223/91 |
| 3,116,860 | 1/1964 | Urich | 223/85 |
| 3,209,966 | 10/1965 | Wach | 223/93 |
| 3,456,262 | 7/1969 | Coon . | |
| 4,192,441 | 2/1980 | Batts . | |
| 4,261,121 | 4/1981 | Coon | 223/96 X |
| 4,335,838 | 5/1982 | Bisk et al. | 223/91 |
| 4,395,799 | 8/1983 | Batts | 223/96 X |
| 4,638,930 | 3/1987 | Blanchard . | |
| 4,660,750 | 10/1987 | Blanchard . | |
| 4,701,983 | 10/1987 | Warmath | 223/91 X |

FOREIGN PATENT DOCUMENTS

| | | | |
|---|---|---|---|
| 1210426 | 3/1960 | France | 223/96 |

*Primary Examiner*—Werner H. Schroeder
*Assistant Examiner*—David K. Suto
*Attorney, Agent, or Firm*—Price, Heneveld, Cooper, DeWitt & Litton

[57] ABSTRACT

An article hanger includes a body defining a bottom flange. A pair of adjustable clips are snapped onto the hanger. Each clip includes an article clamp assembly mounted on a bracket. The bracket inclues a top portion defining a channel which is snapped onto the hanger body bottom flange.

27 Claims, 4 Drawing Sheets

HANGER WITH SNAP-ON ADJUSTABLE CLIPS

BACKGROUND OF THE INVENTION

The present invention relates to article hangers and more particularly to a unique adjustable clip for converting a conventional garment hanger into a suit hanger.

A wide variety of article or garment hangers have been developed for the transport and/or display of tops such as blouses and shirts, outerwear such as coats and slacks and skirts. Different hangers are used for pants, slacks and skirts than for tops or outerwear. If garments such as blouses and slacks are sold as coordinated outfits or in color combinations, it is desirable to display the articles together. Heretofore, various arrangements have been provided to accomplish such. For example, a coat, blouse or shirt hanger may include an elongated rod extending between the ends of the hanger arms. Clothespin type clamps are on the horizontally extending rod. The clamps may be used to suspend a skirt or a pair of slacks from the hanger. With this approach, versatility is provided. However, the added expense of the horizontally extending rod and clamps is unnecessary if the hanger is used only for display of blouses, shirts or coats.

Proposals have been made to provide a detachable pants bar for a garment hanger to overcome the aforementioned problem. An example of one such hanger may be found in U.S. Pat. No. 4,046,293 entitled DETACHABLE BAR FOR GARMENT HANGER and issued on Sept. 6, 1977 to Garrison. If the hanger is to be used to support a pair of pants or slacks and a coat, a pants bar may be attached in a snap fit fashion to the garment hanger.

With pants, slacks and skirts, clamps may be preferred for display, transport or support. Examples of pant or skirt hangers may be found in U.S. Pat. No. 3,767,092 entitled GARMENT CLAMPING HANGER WITH SLIDABLE LOCKING CLIP and issued on Oct. 23, 1973 to Batts et al; U.S. Pat. No. 4,446,996 entitled MEANS OF SECURING GARMENT CLAMPS TO HANGERS and issued on May 8, 1984 to Garrison; and U.S. Pat. No. 4,638,930 entitled HANGER LEG MOUNTING STRUCTURE FOR A SUPPORT ROD and issued on Jan. 27, 1987 to Blanchard.

U.S. Pat. No. 4,446,996 discloses a garment hanger including a pair of outwardly extending arms which are cut from steel rod or steel wire. Clamps are supported on the rod-like arms. The clamps define circular channels which may be pressed onto the rod. U.S. Pat. No. 4,638,930 discloses a pant or skirt hanger which includes a plastic body having depending legs. An elongated wire or metal rod is supported by the depending legs. A pair of generally H-shaped clamps are adjustably positioned on the elongated rod. The clamps include a pair of wings or members which are biased into a closed or clamping position by a spring.

Proposals have been made for ganging together a hanger such as that disclosed in U.S. Pat. No. 4,638,930 with a tops or upper garment hanger. U.S. Pat. No. 4,653,678 entitled GANGING HOOK FOR GARMENT HANGERS and issued on Mar. 31, 1987 to Blanchard et al discloses a molded plastic hanger which includes a central neck portion, outwardly extending arms and a centrally positioned support hook. The hanger also defines a hook anchor positioned below and in vertical alignment with the hanger support hook. The hook anchor is dimensioned to receive a support hook of another hanger such as a pant/skirt hanger. In this fashion, the hangers may be ganged together and coordinated outfits may be displayed or transported together.

With presently known arrangements, in order to increase the versatility of a tops, upper garment or outerwear hanger, special provision must be made in the hanger construction to accept or gang together another hanger, to add a pants bar or to add support structure for clamps. A need exists for a device which will convert a conventional upper garment hanger into a suit hanger which does not require modification of the basic garment hanger but which provides increased versatility, reduced assembly difficulty and costs.

SUMMARY OF THE INVENTION

In accordance with the present invention, the aforementioned needs are fulfilled. Essentially, an article clamp is supported on an attachment means or bracket. The bracket may be snapped onto a lower flange of a conventional garment hanger without the use of tools. A pair of the brackets and clamps may be secured to the lower flange of a hanger to support pants, slacks, skirts and the like. The brackets are adjustably positionable or movable along the hanger so that they may be placed in parallel relationship at the same horizontal level.

In the preferred form, the bracket includes a top portion, depending side members and a clamp bar. A clamp assembly is mounted on the clamp bar. The top portion of the bracket defines an upwardly opening channel. The channel includes an inwardly turned flange or lip. The channel is configured so that it may be snapped onto a lower flange of a conventional hanger. As a result, clamps may be readily added to conventional hangers. The need for a special hanger structure to accept the clamps is eliminated. Hangers may be converted to suit hangers as necessary. The additional cost associated with pants bars, elongated rods to support clamps or with using a plurality of hangers to display coordinated outfits is eliminated.

DETAILED DESCRIPTION OF THE PREFERRED EMBODIMENT

Figure 1:
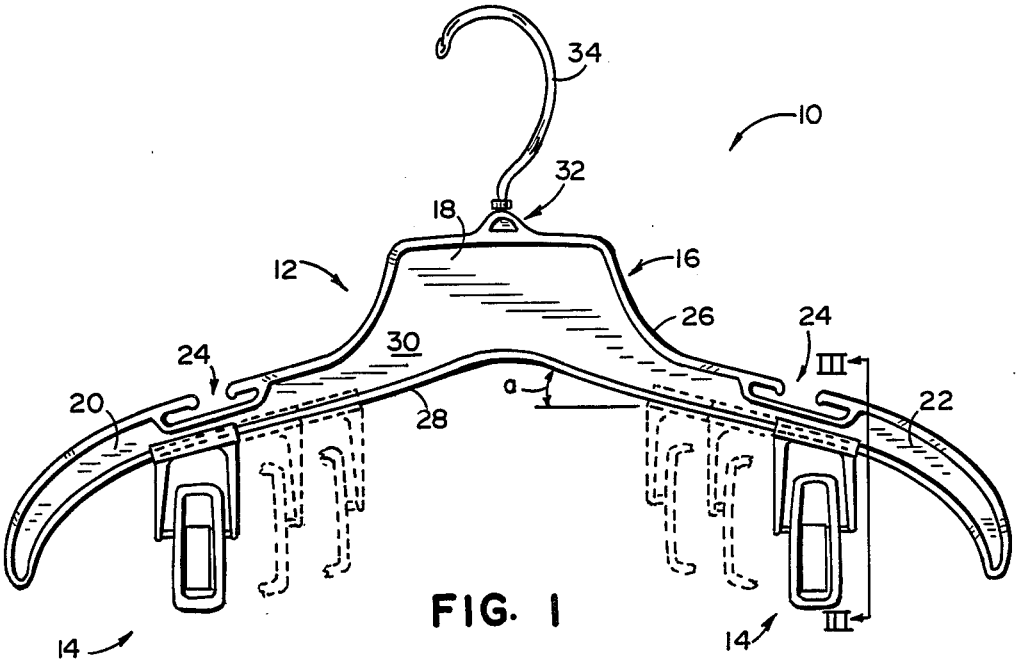
FIG. 1 is a front, elevational view of a hanger and adjustable clips in accordance with the present invention.

A combination garment hanger in accordance with the present invention is illustrated in FIG. 1 and generally designated by the numeral 10. Combination hanger 10 includes a conventional dress or tops hanger 12 and a pair of slidingly adjustable clips 14. Hanger 12 includes a one-piece, molded plastic body 16. Body 16 defines a central head or neck portion 18 and a pair of outwardly extending arms 20, 22. Arms 20, 22 may define garment strap notches 24. Hanger 12 has a generally I-beam configuration (FIGS. 1 and 3) and includes a top flange 26 and a bottom flange 28. Flanges 26, 28 are joined by a central web 30. Hanger body 16 defines a hook boss 32. As illustrated, hook boss 32 receives a wire hook 34. In the alternative, a fixed hook molded with the hanger body could be included. Arms 20, 22 and the lower flange 28 thereof define a slope angle "a" from horizontal (FIG. 1). In an existing embodiment of hanger 12, the slope angle "a" is equal to approximately 13°.

As is well known, hangers of the type designated by the numeral 12 are used to support, display and transport various garments such as blouses, shirts, coats, dresses and other tops, upper garments and outerwear. In accordance with the present invention, such a hanger is readily converted to a suit type hanger wherein the tops or upper garment may be displayed with additional articles of clothing such as a skirt or a pair of slacks or pants.

Figure 2:
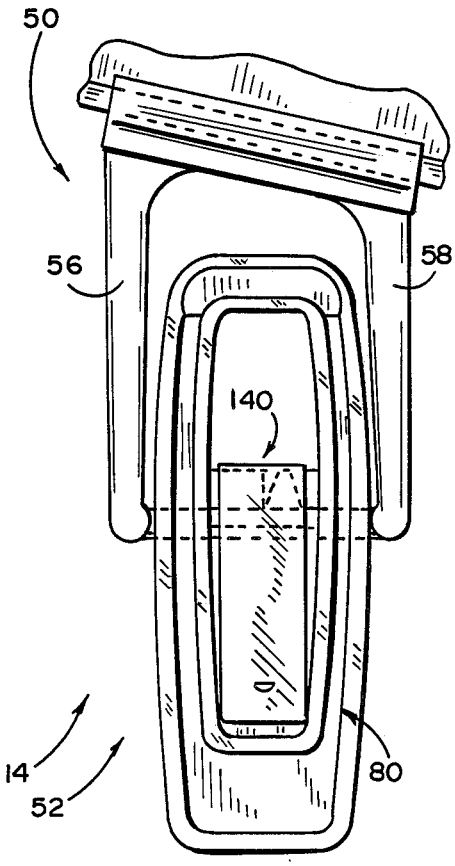
FIG. 2 is an enlarged, fragmentary, front elevational view showing a portion of the hanger and one clip.

Adjustable clips 14 each include a bracket 50 and a garment or article clamp assembly 52 (FIG. 2). As best seen in FIGS. 4–7, bracket 50 is preferably formed as a one-piece item. Bracket 50 includes a top or upper portion 54, integral side members 56, 58 and a bottom, cross or clamp bar 60. Bar 60 is generally circular in cross section. In the embodiment illustrated in FIG. 4, side member 56 has a length greater than the length of side member 58. Top portion 54, therefore, assumes an angle "b" from horizontal which is greater than zero. Angle "b" is equal to the slope angle "a" of the hanger 12 with which bracket 50 is to be used.

Figure 7:
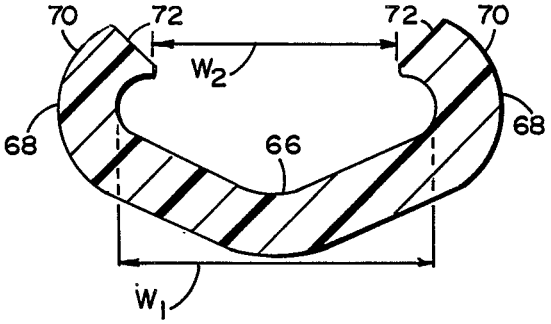
FIG. 7 is an enlarged, cross-sectional view taken generally along line VII—VII of FIG. 4.
Figure 16:
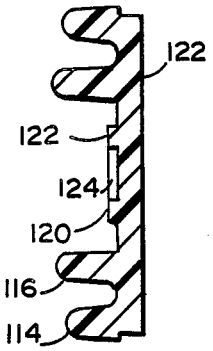
FIG. 16 is a cross-sectional view taken generally along line XVI—XVI of FIG. 10.

Top portion 54 of bracket 50 defines a means for attaching the bracket and hence the clamp assembly 52 to hanger 12. Portion 54 defines an upwardly opening channel 64. Channel 64 is defined by a base 66, sides 68 and inwardly turned flanges or lips 70. As best seen in FIG. 7, flanges 70 define an inwardly and downwardly beveled surface 72. The maximum width $w_1$ of channel 64 is greater than the width $w_2$ between opposed lateral edges of inturned flanges 70.

Figure 3:
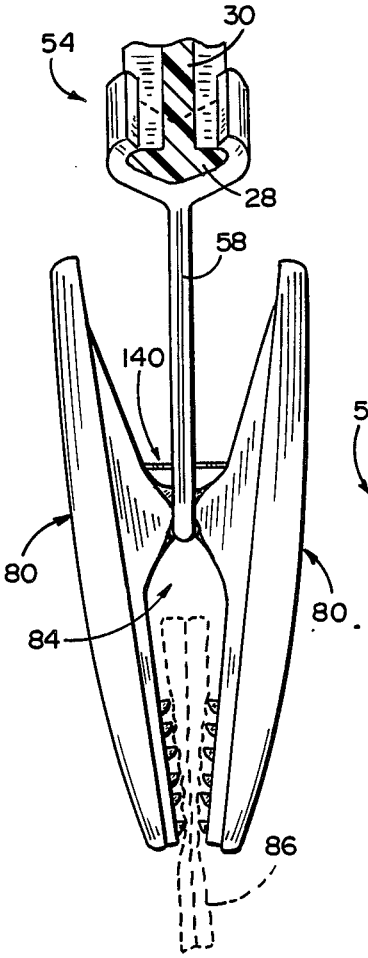
FIG. 3 is a side, elevational view taken generally along line III—III of FIG. 1.

The method of attachment of bracket 54 to conventional hanger 12 is illustrated in FIGS. 2 and 3. As shown therein, the configuration of channel 64 matches the cross-sectional configuration of bottom flange 28. Width $w_1$ of channel 64 is approximately equal to the maximum width dimension of flange 28. Sidewalls 68 and inturned flanges or lips 70 are dimensioned so that top portion 54 may be snapped over flange 28. As top portion 54 is pushed onto the flange, the beveled edges 72 assist in camming the sides apart until flange 28 clears the edges and snaps into the main portion of the channel. Bracket 54 is, therefore, easily positioned on a lower flange 28 of hanger 12 without the use of tools. Further, as illustrated in FIG. 1, the brackets may be adjusted by sliding them along the flange to various positions. As a result, garments or articles of different width may be easily suspended from the hanger 12. Since angle "b" is equal to the slope angle "a" of hanger 12, the brackets may be adjusted so that they are parallel and in the same horizontal plane when the article is held by clamps 52. Some of the various positions of the clips 14 are shown in phantom in FIG. 1. If clamp assemblies 52 are no longer needed, channel 64 may be expanded by hand or with a small tool and the brackets removed from the hanger.

Figure 8:
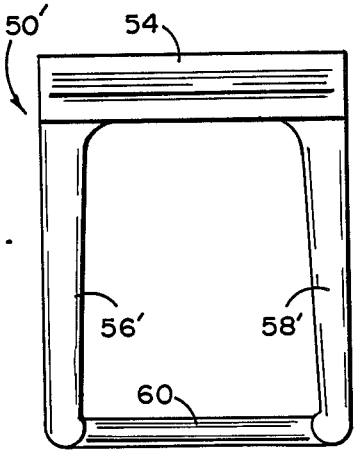
FIG. 8 is a front, elevational view of an alternative bracket in accordance with the present invention.

FIG. 8 illustrates an alternative bracket 50'. Bracket 50' is designed for use with a hanger which has a slope angle of zero. Side members or supports 56' and 58' are of the same dimension. Bracket 50' includes a top portion 54' having the same configuration as portion 54 of embodiment 50. Similarly, bracket 50' includes a clamp bar 60 which is circular in cross section.

Figure 15:
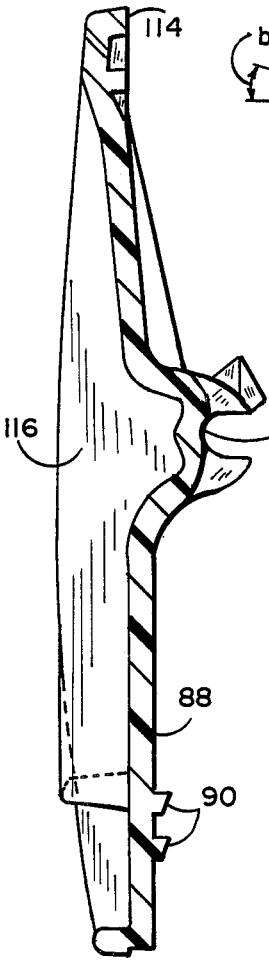
FIG. 15 is a cross-sectional view taken generally along line XV—XV of FIG. 10.
Figure 4:
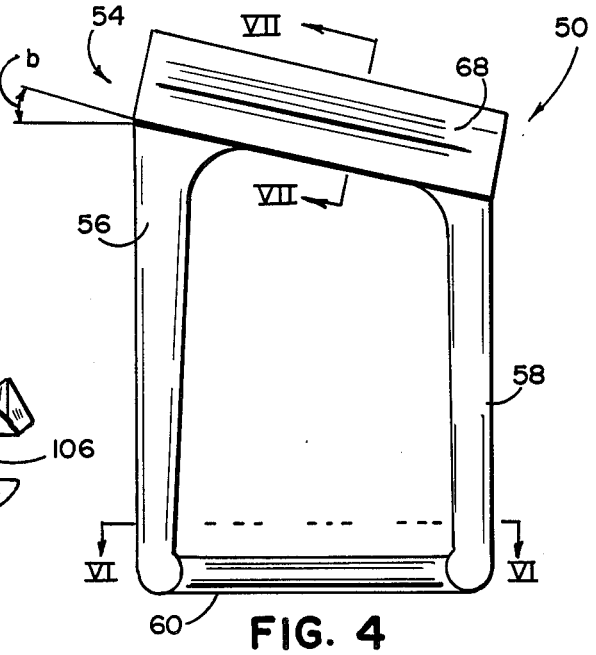
FIG. 4 is a front, elevational view of the bracket incorporated in the present invention.
Figure 5:
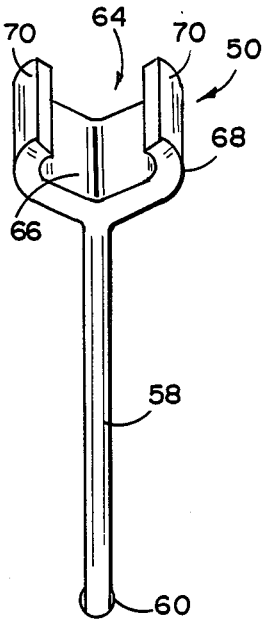
FIG. 5 is a side, elevational view of the bracket.
Figure 6:
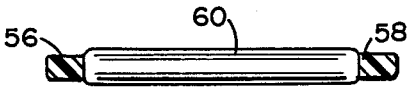
FIG. 6 is a cross-sectional view taken generally along line VI—VI of FIG. 4.
Figure 9:
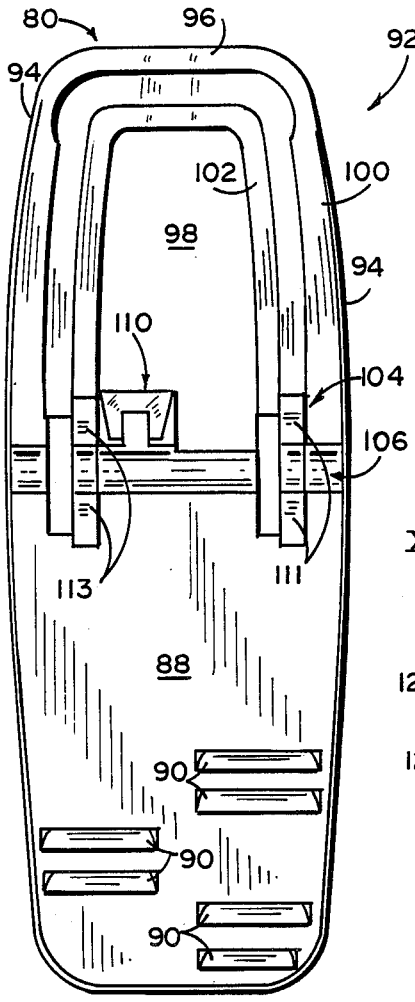
FIG. 9 is a front, elevational view of a clamp member incorporated in the present invention.
Figure 10:
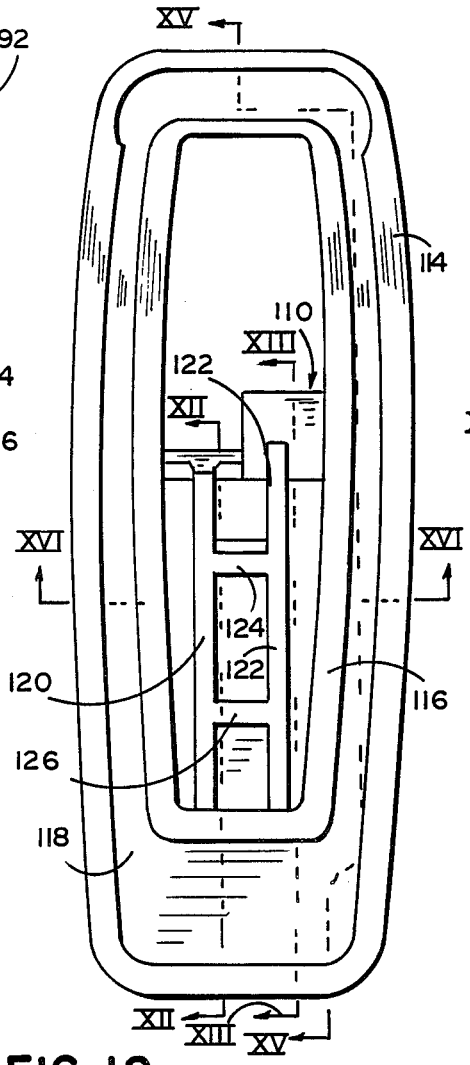
FIG. 10 is a rear, elevational view of the clamp member of FIG. 9.

Clamp assembly 52, as shown in FIG. 3, is generally H-shaped in side elevation and includes a pair of identical clamp members or halves 80. Members 80 define a garment receiving channel 84 within which a garment 86 may be held. As seen in FIGS. 9 and 10, clamp member 80 includes an inner clamping face 88 which defines a plurality of garment engaging teeth 90. Face 88 is generally planar (FIG. 15). Member 80 defines an upper portion 92 which includes handles or grasping members 94 joined by a top portion 96. Upper portion 92 defines an opening 98. Member 90 on its inner face includes an outer reinforcing rib 100 and an inner reinforcing rib 102. In addition, member 80 defines a transverse rib 104. Rib 104 defines an outwardly opening groove 106. Extending from the inner face of member 80 immediately adjacent rib 102 and rib 104 is an alignment rib or hinge leaf 110.

Figure 11:
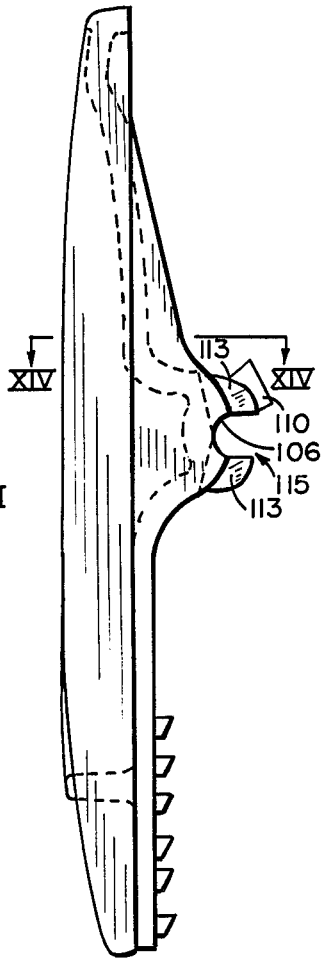
FIG. 11 is a side, elevational view of the clamp member of FIG. 9.
Figure 12:
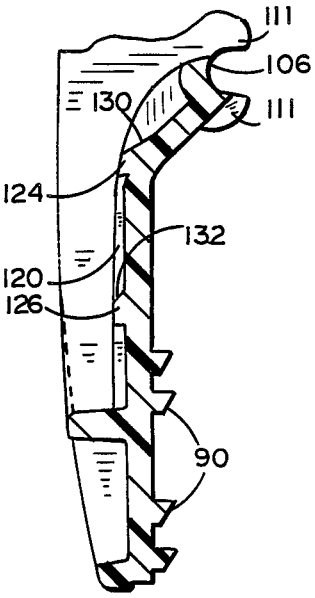
FIG. 12 is a cross-sectional view taken generally along line XII—XII of FIG. 10.

In addition, member 80 defines spaced hinge fingers 111, 113. Fingers 111 extend outwardly adjacent rib 102 between ribs 102 and 100. Fingers 113 extend outwardly from the face of rib 102. As seen in FIGS. 11 and 12, fingers 111, 113 define U-shaped slots 115. The slots receive pivot bar 60 and the fingers interleave improving the hinge or pivot action.

Figure 18:
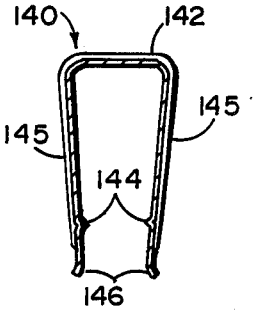
FIG. 18 is a side, elevational view of a spring clip incorporated in the clamp assembly.
Figure 13:
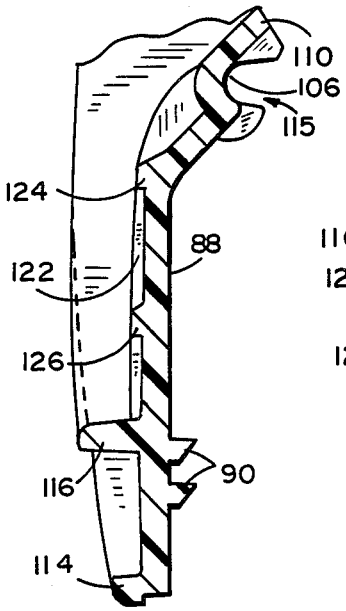
FIG. 13 is a cross-sectional view taken generally along line XIII—XIII of FIG. 10.
Figure 14:
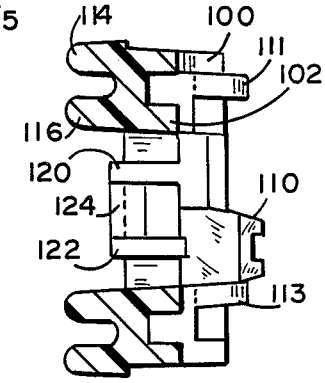
FIG. 14 is a cross-sectional view taken generally along line XIV—XIV of FIG. 11.
Figure 19:
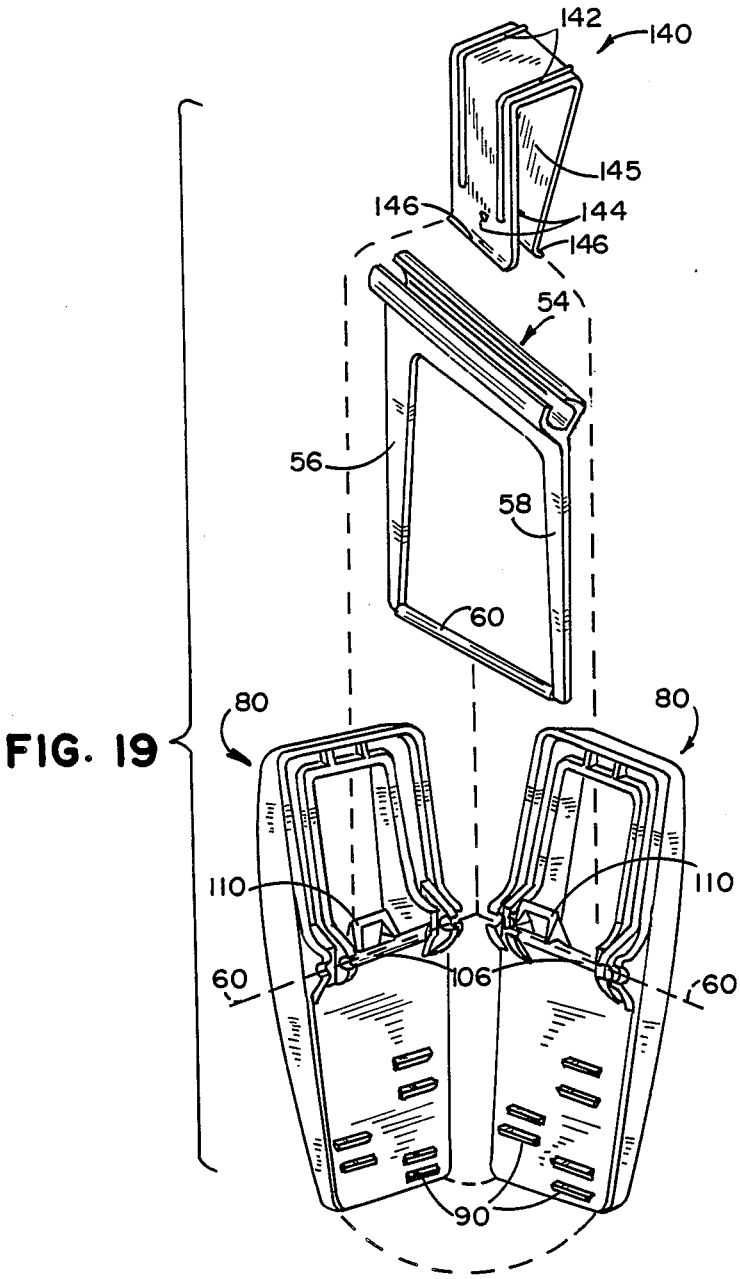
FIGS. 19 and 19A are exploded views showing the manner of assembly of the clamp elements on the bracket.
Figure 19A:
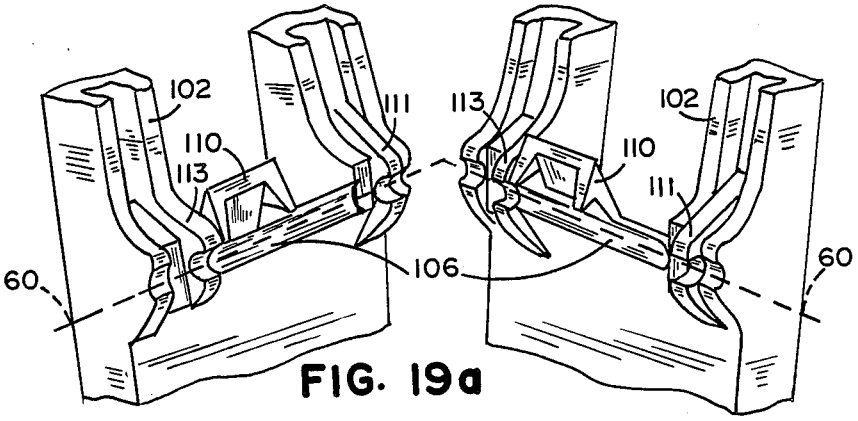

An outer face 112 of member 80 includes an outer reinforcing rib 114 and an inner reinforcing rib 116. Ribs 114, 116 are joined by an outer surface 118. Member 80 defines spring guide ribs 120, 122. Extending between ribs 120, 122 are horizontal stop ribs 124, 126. Ribs 124, 126 include upper beveled faces 130, 132 (FIGS. 12 and 13). As seen in FIGS. 2 and 3, clamp members 80 are held together by a generally U-shaped spring 140. Spring 140, as also seen in FIG. 18, includes reinforcing ribs 142, detents 144, legs 145 and outwardly turned ends 146.

Figure 17:
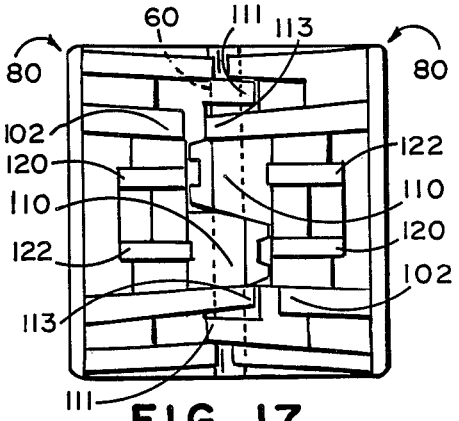
FIG. 17 is a top, plan view showing a pair of clamp members positioned in opposed relationship.

As seen in FIGS. 2, 3, 19 and 19A, when a pair of clamp members 80 are positioned in opposed relationship, grooves 106 of each member 80 define a hinge groove which receives cylindrical bar 60. Bar 60 functions as a hinge or pivot pin. When members 80 are positioned in opposed relationship, alignment ribs or hinge leaves 110 are positioned adjacent each other (FIG. 17). Fingers 111, 113 of each member 80 interleaf and receive bar 60. Ribs 110 and fingers 111, 113, therefore, align or guide halves 80 as they pivot or hinge about bar 60. Spring 140 is aligned with guide ribs 122, 120 and pushed downwardly. The legs of the spring open and detents 144 snap over stops 124, 126. Detents 126 prevent inadvertent removal of spring 140. As shown in FIG. 3, spring 140 biases the lower or clamping portions of members 80 into clamping engagement. Clamp assembly 52 may be opened to receive a garment by grasping of handle or upper portions 92 of members 80 and moving them towards each other. Members 80 will, therefore, pivot against the resilient bias of spring 140 about bar 60.

Alternative clamps, such as the clamp disclosed in aforementioned U.S. Pat. No. 4,638,930, can be used in the present invention. The clamp of the '930 patent differs principally in its inclusion of an alignment web in place of the alignment ribs 110 illustrated herein. The disclosure of the '930 patent is hereby incorporated by reference. In addition, a clamp similar to the type disclosed in the aforementioned U.S. Pat. No. 4,446,996 may also be substituted for clamp 52. The clamp of the '996 patent defines a channel which can be snapped over bar 60 of clamp 54.

Bracket 54 and the clamp members are preferably molded as one-piece items from a suitable resilient plastic. The material may be those presently employed in the garment hanger industry such as polypropylene. Other materials such as polystyrene might also be used.

The adjustable clip in accordance with the present invention readily converts a conventional tops or upper garment hanger into a suit or combination hanger. Bracket 50 has its top portion 54 configured to correspond to the shape of the bottom flange of hanger 12. The bracket may be molded in configurations other than that disclosed to match other hanger flange configurations such as circular shapes, T-shapes, L-shapes and the like. The bracket readily snaps onto existing hangers without the need for tools. The bracket may be manually removed from the hanger and reused.

In view of the foregoing description, those of ordinary skill in the art may envision various modifications which would not depart from the inventive concepts disclosed herein. It is, therefore, expressly intended that the above description should be considered as only that of the preferred embodiment. The true spirit and scope of the present invention may be determined by reference to the appended claims.

The embodiments of the invention in which an exclusive property or privilege is claimed are defined as follows:

1. An article hanger for garments and the like, said hanger comprising:

a hanger body, said body defining an elongated bottom flange having a slope angle;

article clamp means defining opposed clamping surfaces for clampingly engaging an article and suspending the article from the hanger body; and attachment means connected to said clamp means for adjustably attaching said clamp means to said hanger body bottom flange for movement along said bottom flange, said attachment means including a top portion having an angle from horizontal which is the same as the slope angle of said bottom flange.

2. An article hanger as defined by claim 1 wherein said attachment means comprises:

a one-piece bracket, said bracket defining spaced, parallel sides joined together by said top portion and a bottom bar.

3. An article hanger as defined by claim 2 wherein said article clamp means defines a hinge groove within which said bottom bar is disposed.

4. An article hanger as defined by claim 2 wherein said bracket top portion defines a channel having inturned lips, said channel being configured to match the cross-sectional configuration of said flange, said channel receiving said flange in a snap fit manner.

5. An article hanger as defined by claim 4 wherein said clamp means comprises:

a pair of opposed clamp members, each member defining a lower clamping surface and an upper handle, said clamping surface and handle being separated by a transverse rib, said rib defining an outwardly opening hinge groove, said grooves receiving said bottom bar of said bracket.

6. An article hanger as defined by claim 5 wherein each of said clamp means further includes a spring engaging said clamp members to resiliently bias said clamping surfaces into a garment engaging position.

7. An article hanger as defined by claim 1 wherein said clamp means includes a spring for resiliently biasing said clamping surfaces into a garment engaging position.

8. An article hanger as defined by claim 6 wherein said clamp members each include an alignment leaf and spaced hinge fingers adjacent said hinge groove.

9. An article hanger as defined by claim 8 wherein said clamp members each define a stop rib and wherein said spring is generally U-shaped in side elevation and includes a base joined to a pair of legs, each leg defining a detent which will engage one of said stop ribs to retain said spring on said clamp members.

10. An article hanger as defined by claim 4 wherein said lips of said channel are beveled inwardly and downwardly.

11. An article hanger as defined by claim 9 wherein said lips of said channel are beveled inwardly and downwardly.

12. An article hanger as defined by claim 11 wherein said bottom bar of said bracket is circular in transverse cross section.

13. An adjustable, snap-on clip for use with a garment hanger of the type having a hanger body which defines an elongated lower flange, said clip comprising:

a bracket, said bracket including a hinge bar and spaced sides attached to the hinge bar;

snap-on attachment means on said bracket for snapping said bracket onto the lower flange of the hanger body and for permitting adjustment of the bracket along said flange; and article clamp means on said hinge bar for clamping and suspending an article from said bracket.

14. A clip as defined by claim 13 wherein said snap-on attachment means defines a channel having an inturned lip, said attachment means being formed from a resilient material.

15. A clip as defined by claim 14 wherein said inturned lip is beveled inwardly and downwardly so that said channel may be cammed open to snap onto the hanger body lower flange.

16. A clip as defined by claim 13 wherein said clamp means comprises:

a pair of opposed clamp members, each clamp member including a lower clamping portion and an upper grasping portion, said clamp members defining a hinge groove receiving said hinge bar; and a spring engaging said clamp members for biasing said clamping portions into engagement with each other, said members pivoting about said hinge bar.

17. A clip as defined by claim 16 wherein each of said clamp members further defines an alignment leaf adjacent said hinge groove, said leaves keeping said clamp members in alignment as the clamping surfaces are moved away from each other against the bias of said spring.

18. A clip as defined by claim 15 wherein said hanger body flange defines a slope angle and wherein said attachment means defines an angle from horizontal which equals said slope angle.

19. A clip as defined by claim 18 wherein said clamp means comprises:

a pair of opposed clamp members, each clamp member including a lower clamping portion and an upper grasping portion, said clamp members defining a hinge groove receiving said hinge bar; and a spring engaging said clamp members for biasing said clamping portions into engagement with each other, said members pivoting about said hinge bar.

20. A clip as defined by claim 19 wherein each of said clamp members further defines an alignment leaf adjacent said hinge groove, said leaves keeping said clamp members in alignment as the clamping surfaces are moved away from each other against the bias of said spring.

21. An adjustable article clamp bracket for use with a hanger having a body defining a flange, said bracket comprising:

a one-piece body, said body including a top portion, a bottom clamp bar for supporting a clamp assembly and a side member joining said clamp bar to said top portion, said top portion defining an open-ended snap-on channel having an inturned detent lip, said channel being dimensioned to receive the flange of the hanger body in a snap-on, detent fashion.

22. An adjustable article clamp bracket as defined by claim 21 wherein said body defines another side member extending between said top portion and said clamp bar in spaced parallel relationship with said a side member.

23. An adjustable article clamp bracket as defined by claim 22 wherein said channel includes another sidewall and another inturned lip, said lips being beveled inwardly and downwardly to facilitate receipt of the hanger body flange within the channel.

24. An adjustable article clamp bracket as defined by claim 23 wherein said snap-on channel defines an angle from horizontal which is equal to a slope angle of the hanger body flange.

25. An adjustable article clamp bracket as defined by claim 24 wherein said clamp bar is generally circular in cross section.

26. A clamp assembly adapted to be mounted on a hinge bar, said assembly comprising:

a pair of opposed clamp members, each member defining a lower clamping surface and an upper handle, said surface and handle being separated by a transverse rib which defines an outwardly opening hinge groove, each of said members further defining an alignment leaf adjacent said hinge groove and spaced hinge fingers, said fingers each defining slots aligned with said groove, said fingers of said member interfitting about the hinge bar; and a spring engaging said clamp member for resiliently biasing said clamping surface into a garment engaging position.

27. A clamp assembly as defined by claim 26 wherein said clamp members each define a stop rib and wherein said spring is generally U-shaped in side elevation and includes a base joined to a pair of legs, each leg defining a detent which will engage one of said stop ribs to retain said spring on said clamp members.

* * * * *